United States Patent [19]

Shiga et al.

[11] Patent Number: 4,619,279

[45] Date of Patent: Oct. 28, 1986

[54] TOBACCO SMOKE FILTER

[75] Inventors: Makoto Shiga; Akira Miyazawa; Mitsuyosi Miyutani, all of Osaka, Japan

[73] Assignee: Daicel Chemical Industries Ltd., Osaka, Japan

[21] Appl. No.: 524,141

[22] Filed: Feb. 1, 1983

[51] Int. Cl.[4] ..... A24D 3/04

[52] U.S. Cl. ..... 131/345

[58] Field of Search ..... 131/340, 339, 331, 343, 131/345

[56] References Cited

PUBLICATIONS

*New Cellulosic Fiber,* found in "Proceedings of the American Association of Textile Chemists and Colorists", pp. 138–142, date 9/1960, copy found in Examiners Search Room.

*Primary Examiner*—V. Millin

*Attorney, Agent, or Firm*—Stiefel, Gross, Kurland & Pavane

[57] ABSTRACT

A tobacco smoke filter for use suitable in cigarettes comprising cellulose acetate filaments which have a C-shaped cross section. Such filter shows a good filtration performance with less impairment of the tobacco taste or flavor.

4 Claims, 4 Drawing Figures

TOBACCO SMOKE FILTER

BACKGROUND OF THE INVENTION

1. Field of the Invention

The present invention relates to a tobacco smoke filter suitable for use in cigarettes, pipes, cigarette holders, and cigar holders, more particularly, to a tobacco smoke filter having improved filtering performance by using acetate filaments with a specific cross section as filter fibers.

2. Description of the Prior Art

Tobacco smoke contains aldehydes such as acetaldehyde, formaldehyde and acrolein, ketones such as acetone and phenolic compounds, which cause a bad influence on the tobacco taste or flavor. The tobacco smoke also contains alkaloids such as nicotine, organic acids and benzopyrene generally referred to as tar. It is well known that these substances are injurious to the smoker's health because they put loads on his lung, liver, kidney and stomach.

Various attempts have been made to remove these injurious tobacco components without impairing the tobacco taste or flavor, but none has been found completely satisfactory. A filter made of a tow of cellulose acetate filaments is in common use and in most cases, the filaments have a regular cross section (a) or an I-shape (b) or a Y-shape (c) produced by spinning through a spinneret (FIG. 1). The last two patterns are more often used because of their greater filtering ability, but on the other hand, filters using filaments having I-shape or Y-shape impair the tobacco flavor. Filters using filaments having a regular cross section are more effective in retaining the tobacco flavor or taste but, for the same filling density (the number of filaments with which a specific filter is filled), they have a lower pressure drop and less removal of tar and nicotine than filters using filaments having an I-shape or Y-shaped cross section.

Therefore, the present inventors have made various studies on the shape of the cross section of cellulose acetate filaments composing tobacco smoke filters so as to produce filters capable of very efficient removal of tars, nicotine and other injurious materials from tobacco smoke with less impairment of the tobacco flavor. As a result, the inventors have found that a filter made of cellulose acetate fibers having a C-shaped cross section has great ability to remove nicotine and tars without impairing the tobacco flavor and can be manufactured on an industrial scale.

SUMMARY OF THE INVENTION

The present invention provides a tobacco smoke filter made of cellulose acetate filaments at least part of which have a C-shaped cross section. The C-shaped cross section can be expressed by a shape factor $A/T^2$ in which A is the area of the cross section and T is the thickness in the center of the cross section.

DESCRIPTION OF THE PREFERRED EMBODIMENTS

The tobacco smoke filter of the present invention is made of cellulose acetate fibers which have a C-shaped cross section. The cellulose acetate fibers having C-shaped cross section may be manufactured by spinning a solution of cellulose acetate through a spinneret, in accordance with the method described, e.g., in Japanese Patent Publication No. 14012/1964. The ability of this filter to retain the tobacco flavor is even greater than that of a filter made of filaments having a regular shaped cross section which is conventionally regarded to be more effective than an I-shaped or Y-shaped cross section. It is generally said that tobacco smoke filters achieve their filtration function through mechanisms such as inertia, diffusion or blocking, and whichever mechanism is taken, the effectiveness of the filter increases with the increase in the size of the blocking area perpendicular to the direction of smoke flow, or the area of projection to the direction of smoke flow. The area of projection depends on the shape of the cross section of the filaments and the number of crimps given each filament, in the case where the number and fineness of filaments per unit cross-sectional area are defined. The filaments having a C-shaped cross section according to the present invention are very bulky as is apparent from their shape, so they have a large area of projection in the direction of smoke flow for a given weight, and effective filtering is achieved. Maximum blocking area can be provided by using thin-walled C-shaped filaments. For a given filing density (i.e. the filter is filled with the same amount of filaments), a filter using thin-walled C-shaped filaments presents a higher pressure drop and hence achieves a higher filtering action than filters using otherwise shaped cross sections.

Figure 1:
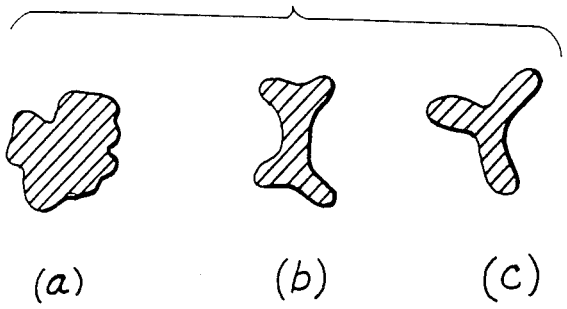
FIG. 1 PRIOR ART
FIG. 1 shows schematically the cross section of conventional cellulose acetate filaments used in tobacco smoke filters; (a) is a regular cross section, (b) an I-shaped cross section, and (c) a Y-shaped cross section.
Figure 2:
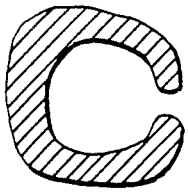
FIG. 2 shows schematically the cross section of cellulose acetate filaments used in the filter of the present invention.

The shape of the cross section of a fiber can be ascertained by making a microscopic observation or taking an enlarged picture of a fiber sample cut perpendicular to the axis. As shown in FIG. 2, the cross section of C-shaped filament is represented by the shape factor $A/T^2$, wherein A is the area of the cross section as indicated in square millimeters and T is the thickness in the center of the cross section as indicated in millimeters. The smaller the shape factor, the thicker the wall of the C-shaped fibers. The larger the shape factor, the thinner the wall. According to the present invention, the filaments having a C-shaped cross section preferably have a shape factor of 3 to 10, and to provide a larger blocking area, the shape factor of 4 to 10 is more preferred.

By using such thin-walled C-shaped filaments, a highly effective tobacco smoke filter can be manufactured in a relatively small filling density, and this is one great advantage for saving cellulose fibers. It is generally understood that filters made of filaments having a regular shaped cross section retain more tobacco flavor than those using an I-shaped or Y-shaped cross section, but the filter made of filaments having a C-shaped cross section is more effective, although the exact reason for this fact is yet to be understood.

According to the present invention, the filter is preferably made of filaments all of which have a C-shaped cross section, but it may be made of a mixture of filaments having a C-shaped cross section and those having otherwise shaped cross section such as an I or Y-shape. In the latter case, the intended object of the present invention (obtaining the good tobacco flavor) can be obtained if at least 10 wt% of the filaments composing the filter is assumed by filaments having a C-shaped cross section.

The filter of the present invention is usually made of a tow of 3,000 to 100,000 continuous cellulose acetate filaments of 0.8–16 denier per filament with 20 to 32 uniform crimps per 25 mm. A conventional plasticizer such as triacetin may be used for the cellulose acetate fibers, and a filter may be manufactured by the commonly employed process for manufacturing tobacco smoke filters from cellulose acetate fibers.

As described in the foregoing, the tobacco smoke filter of the present invention is capable of efficient filtration without impairing tobacco flavor and it achieves these advantages even if it is filled with fewer cellulose acetate filaments than are conventionally required.

The present invention is now described in greater detail by reference to the following non-limiting examples, wherein the pressure drop and the removal rate of nicotine and tars were measured by the conventional methods.

Pressure drop

Air was passed through a specific filter or filter-tipped cigarette at 17.5 ml/sec. and its pressure drop was indicated in mm of water gauge.

Removal rate of nicotine and tars

A filter-tipped cigarette was smoked, and the amounts of nicotine and tar contained in the smoke that passed through the filter and those trapped in the filter were determined by liquid chromatography and their weights were measured. The proportions of nicotine and tar trapped in the filter were indicated in percents by weight.

EXAMPLE 1

A tow of cellulose acetate filaments of 4.8 denier per filament and 28 crimps per 25 mm having a thin-walled ($A/T^2=5.5$) C-shaped cross section as shown in FIG. 2 with a total denier of 38,000 was used. The tow was bloomed and manufactured, with 5 wt.% of triacetin as plasticizer wrapped with paper, into a cylindrical rod. The filter rod dimensions were 24.7 mm in circumference and 102 mm in length. The filter rod was cut to 17 mm long filter tip. Their pressure drop and the filling density of the filaments were measured. The filter tips were removed from Japanese commercial cigarettes of the brand "Hi-Lite" and the filters prepared according to the present invention above were attached to them and their removal rate of nicotine and tar were measured.

Assuming that the interior of the filter is filled with cellulose acetate, filaments having a C-shaped cross section of 4.8 denier correspond to filaments with a regular shaped cross section of 6 denier. Therefore, filters were prepared from a tow of a total denier of 38,000 and cellulose acetate filaments of 6 denier having a regular shaped cross section as in the manner described above, and their pressure drop, filling density of the filaments, and removal rate of nicotine and tar were checked. The results are shown in Table 1 below.

Cigarettes with the two types of filter tip were smoked by 20 panelists to evaluate the tobacco flavor. The results are also shown in Table 1 from which one can see that the filters made of filaments of a C-shaped cross section, in spite of their lower filling density, achieved a higher pressure drop and a higher removal of nicotine and tar than the filters made of filaments of a regular shaped cross section. A significant proportion of the panelists preferred the former type of filters in the sensory evaluation test.

TABLE 1

| | Pressure drop (mm $H_2O$) | Filling density (g) | Tar removal (%) | Nicotine removal (%) | Flavor |
|---|---|---|---|---|---|
| Example 1 (C-shaped cross section) | 37 | 0.125 | 41 | 27 | Preferred by 80% of the panelists |
| Comparative sample (regular shaped cross section) | 33 | 0.150 | 30 | 22 | Preferred by 20% of the panelists |

EXAMPLE 2

Four different tows each being made of a mixture of cellulose acetate filaments of 4.8 denier per filament having a thin-walled ($A/T^2=5.5$) C-shaped cross section with 28 crimps per 25 mm and those of the same denier per filament having Y-shaped cross section with the same number of crimps per 25 mm were prepared. The tows each had a total denier of 43,000, and the proportions of the filaments having a C-shaped cross section in the four tows were 20%, 10%, 5% and 0%, respectively. Four filter rods having a length of 102 mm, a circumference of 24.7 mm, a pressure drop of $250\pm20$ mm$H_2O$ and different contents of filaments with a C-shaped cross section were made from these tows as in Example 1. Each rod was cut into 17 mm long filter tips, which were attached to Japanese commercial cigarettes of the brand "Hi-Lite" from which the filter tips had been removed. The cigarettes were smoked by 20 panelists to evaluate the tobacco flavor. The results are shown in Table 2, from which one can see that a significant number of the panelists preferred the filters containing at least 10% of the filaments having a C-shaped cross section, and this clearly demonstrates the effectiveness of filaments with a C-shaped cross section in retaining the tobacco flavor.

TABLE 2

| Contents of filaments having a C-shaped cross section (%) | No. of panelists who preferred the incorporation of C-shaped cross section | No. of panelists who preferred filaments having only a Y-shaped cross section | No. of panelists who could not say which they preferred |
|---|---|---|---|
| 5 | 3 | 2 | 15 |
| 10 | 11 | 2 | 7 |
| 20 | 15 | 1 | 4 |

What is claimed is:

1. A tobacco smoke filter comprising cellulose acetate filaments having a C-shaped cross section.

2. A tobacco smoke filter according to claim 1 wherein said cellulose acetate filaments are thin-walled and of substantially uniform C-shaped cross section.

3. A tobacco smoke filter according to claim 1 wherein said C-shaped cross section has a shape factor ($A/T^2$) of 3 to 10, wherein A is the area of the cross section and T is the thickness in the center of the cross section.

4. A tobacco smoke filter according to claim 1 wherein the cellulose acetate filaments having a C-shaped cross section have 20 to 32 crimps per 25 mm.

* * * * *